US008267482B1

(12) United States Patent
Hall et al.

(10) Patent No.: US 8,267,482 B1
(45) Date of Patent: Sep. 18, 2012

(54) FOAM CONFIGURED TO SUPPRESS DUST ON A SURFACE TO BE WORKED

(76) Inventors: David R. Hall, Provo, UT (US); Logan Gillette, Provo, UT (US); Shaun Austin Heldt, Provo, UT (US)

( * ) Notice: Subject to any disclaimer, the term of this patent is extended or adjusted under 35 U.S.C. 154(b) by 0 days.

(21) Appl. No.: 13/169,704

(22) Filed: Jun. 27, 2011

Related U.S. Application Data

(63) Continuation-in-part of application No. 13/102,827, filed on May 6, 2011.

(51) Int. Cl.
*E01C 23/00* (2006.01)

(52) U.S. Cl. ..... 299/39.4; 299/81.1

(58) Field of Classification Search ..... 299/39.2, 299/39.4, 81.1; 404/90, 91, 94
See application file for complete search history.

(56) References Cited

U.S. PATENT DOCUMENTS

| | | | | |
|---|---|---|---|---|
| 3,822,955 | A * | 7/1974 | Haferkamp et al. | 404/72 |
| 4,191,426 | A * | 3/1980 | Ely | 299/39.2 |
| 4,400,220 | A | 8/1983 | Cole | |
| 4,417,992 | A | 11/1983 | Bhattacharyya | |
| 4,487,615 | A | 12/1984 | Taylor | |
| 4,551,261 | A | 11/1985 | Salihar | |
| 4,561,905 | A | 12/1985 | Kittle | |
| 4,780,143 | A | 10/1988 | Roe | |
| 5,296,264 | A | 3/1994 | Blacklidge | |
| 5,500,220 | A | 3/1996 | Roe | |
| 6,276,459 | B1 * | 8/2001 | Herrick et al. | 169/14 |
| 6,565,281 | B2 * | 5/2003 | Bruns et al. | 404/90 |
| 6,726,849 | B2 | 4/2004 | Gay | |
| 6,790,245 | B2 | 9/2004 | Wolff | |
| 7,048,340 | B2 * | 5/2006 | Lammer et al. | 299/12 |
| 7,175,364 | B2 | 2/2007 | Gaertner | |
| 7,219,964 | B2 | 5/2007 | Berning | |
| 7,422,390 | B2 | 9/2008 | Gaertner | |
| 7,585,128 | B2 * | 9/2009 | Hall et al. | 404/75 |
| 7,712,996 | B2 * | 5/2010 | Hall et al. | 404/90 |
| 7,942,605 | B2 * | 5/2011 | Hall et al. | 404/94 |
| 2004/0195545 | A1 | 10/2004 | Gay et al. | |
| 2009/0052987 | A1 * | 2/2009 | Hall et al. | 404/90 |

OTHER PUBLICATIONS

Field Tests of a Foam dust-suppressant system with Longwall shearers Singh et. al Engineers International Inc. 2004.*
Chemstream, Dust Suppression for Longwell and Continuous Miners Stoytown, PA.

* cited by examiner

*Primary Examiner* — John Kreck
(74) *Attorney, Agent, or Firm* — Philip W. Townsend, III

(57) ABSTRACT

In one aspect of the invention, a system for removing aggregate from a natural or man-made surface includes a vehicle with a frame and a conveyor. The conveyor has an intake end and an output end. An excavation drum is connected to an underside of the frame and is enclosed within an excavation chamber, which is defined by a front plate, side plates, and a moldboard. The intake end of the conveyor that protrudes into the excavation chamber is configured to remove the aggregate from the excavation chamber, and a dust suppressant nozzle is configured to apply a foamed dust suppressant to the natural or man-made surface prior to being degraded by the excavation drum.

15 Claims, 15 Drawing Sheets

FOAM CONFIGURED TO SUPPRESS DUST ON A SURFACE TO BE WORKED

CROSS REFERENCE TO RELATED APPLICATIONS

This application is a continuation-in-part of U.S. patent application Ser. No. 13/102,827 filed on May 6, 2011. U.S. patent application Ser. No. 13/102,827 is herein incorporated by reference for all that it discloses.

BACKGROUND OF THE INVENTION

The present invention relates generally to aggregate removal in excavation machines and cleaning paved surfaces. Specifically, the present invention deals with a dust reduction mechanism on excavation machines and street sweepers.

U.S. Patent Application No. 2010/0202832 to Menzenbach et al., which is herein incorporated for all that it contains, discloses an invention related to a civil engineering machine for spreading material for spreading on soils or base materials, and in particular to a civil engineering machine for spreading binders for soil or base material stabilization, which has a container for material for spreading to receive the material for spreading and a spreading arrangement having one or more outlet openings for the discharge of the material for spreading. The invention relaters in this case both to a civil engineering machine which is intended solely for discharging the binder and to a civil engineering machine, and in particular a stabilizer or recycler, which has a excavation mixing rotor by which, directly after the discharge, the binder can be mixed into the soil or base material which has been milled up. The anti-dust arrangement, which is arranged below the outlet openings, is characterized in that there is created below the outlet openings a spreading compartment which is bounded by one or more first anti-dust space which is bounded by one or more second anti-dust members. What is achieved in this way is that dust which occurs when the material for spreading is being discharged is first retained in the spreading compartment which is surrounded by the first anti-dust members, thus enabling the dust to settle on the ground. Quite a high proportion of the dust is trapped by this means at an early stage. The dust which is not retained in the spreading compartment is then captured in the anti-dust space which is surrounded by the second anti-dust members.

U.S. Patent Application No. 2004/0036346 to Klaasse, which is herein incorporated for all that it contains, discloses a method and an apparatus for reducing dust for use with a working machine which is adapted to fragment material from a working surface and includes at least one partially confined space in which dust occurs. A liquid capable of binding dust is provided and the liquid is sprayed into the partially confined space to trap dust particles generated during fragmentation of the material from the working surface.

U.S. Pat. No. 4,400,220 to Cole, which is herein incorporated for all that it contains, discloses an invention that prevents dust, and particularly respirable dust, from becoming airborne at locations where coal or other dusty products are transferred from one support to another, and where spaces between the pieces of broken material open up and would otherwise release dust into the surrounding atmosphere. Foam, having bubbles small enough to be broken by respirable dust particles, is discharged into the spaces where the small bubbles, bursted by the dust particles, implode and wet the particles and cause adherence of the particles to adjacent surfaces, such as other foam or the broken pieces of material that separate to open up the spaces.

BRIEF SUMMARY OF THE INVENTION

In one aspect of the invention, a system for removing aggregate from a natural or man-made surface includes a vehicle with a frame and a conveyor. The conveyor has an intake end and an output end. An excavation drum is connected to an underside of the frame and is enclosed within an excavation chamber, which is defined by a front plate, side plates, and a moldboard. The intake end of the conveyor protrudes into the excavation chamber through an opening. The conveyor is configured to remove the aggregate from the excavation chamber. A dust suppressant nozzle is configured to apply a foamed dust suppressant to the natural or man-made surface prior to being degraded by the excavation drum.

In some embodiments the excavation drum is configured to lift aggregate within the excavation chamber and allows the aggregate to fall onto the intake end of the conveyor that protrudes into the excavation chamber. However, the excavation drum may be configured to move aggregate through the foamed dust suppressant. The foamed dust suppressant may be configured to coat the aggregate as the excavation drum moves the aggregate through the foamed dust suppressant.

In some embodiments, the dust suppressant nozzle is configured to apply the foamed dust suppressant to the natural or man-made surface within the excavation chamber prior to being degraded by the excavation drum. The foamed dust suppressant may comprise a half life that is at least as long as the duration between applying the foamed dust suppressant to a natural or man-made surface and discharging the foamed dust suppressant with broken aggregate off the output end of the conveyor. In some embodiments, an air compressor is configured to mix air with a liquid dust suppressant to form the foamed dust suppressant. However, the foamed dust suppressant may form before the foamed dust suppressant exits the dust suppressant nozzle. Also, the liquid dust suppressant may comprise water and a foaming agent.

In some embodiments the vehicle comprises a mechanism for applying the foamed dust suppressant that comprises the dust suppressant nozzle, at least one hose, a fluid tank, an air compressor, and a pump. The dust suppressant nozzle may be disposed on the inside of the excavation chamber and supported by the front plate, side plates, and/or conveyor. However, the dust suppressant nozzle may also be disposed at an angle to dispense the foamed dust suppressant in the direction towards the excavation drum. The dust suppressant nozzle may comprise a valve that is configured to adjust the consistency of the foamed dust suppressant.

The dust suppressant nozzle may be configured to apply the foamed dust suppressant to form a foam blanket over the natural or man-made surface. The foam blanket may be configured to span the foamed dust suppressant across the width of a cut formed by the excavation drum into the natural or man-made surface. In some embodiments, the foam blanket is configured to expand until it is degraded by the excavation drum.

In another aspect of the invention, a system for removing aggregate from a natural or man-made surface includes an excavation drum connected to a machine. A dust suppressant nozzle is configured to apply a foamed dust suppressant to the natural or man-made surface prior to being degraded by the excavation drum. The machine may be a milling machine, a mining machine, a continuous miner, a long wall machine, or combinations thereof.

In another aspect of the invention, a system for removing aggregate from a natural or man-made surface includes a nozzle configured to apply a liquid to the natural or man-made surface prior to being degraded by the excavation drum. The liquid may be a liquid dust suppressant that comprises water and a dust binding agent.

In some embodiments the nozzle is a spray nozzle configured to spray the natural or man-made surface prior to being degraded by the excavation drum. The spray nozzle may be a hydraulic nozzle, an air-assisted nozzle, or an ultrasonic nozzle. The nozzle may have multiple orifices.

In some embodiments the nozzle may be a fogging nozzle configured to wet the natural or man-made surface prior to being degraded by the excavation drum.

In some embodiments the nozzle is a water jet cutting nozzle configured to jet fluid in the direction towards the natural or man-made surface proximate the cut formed by the excavation drum into the natural or man-made surface. The water jet cutting nozzle may be configured to degrade the natural or man-made surface preceding the cut formed by the excavation drum into the natural or man-made surface.

DETAILED DESCRIPTION OF THE INVENTION AND THE PREFERRED EMBODIMENTS

Figure 1:
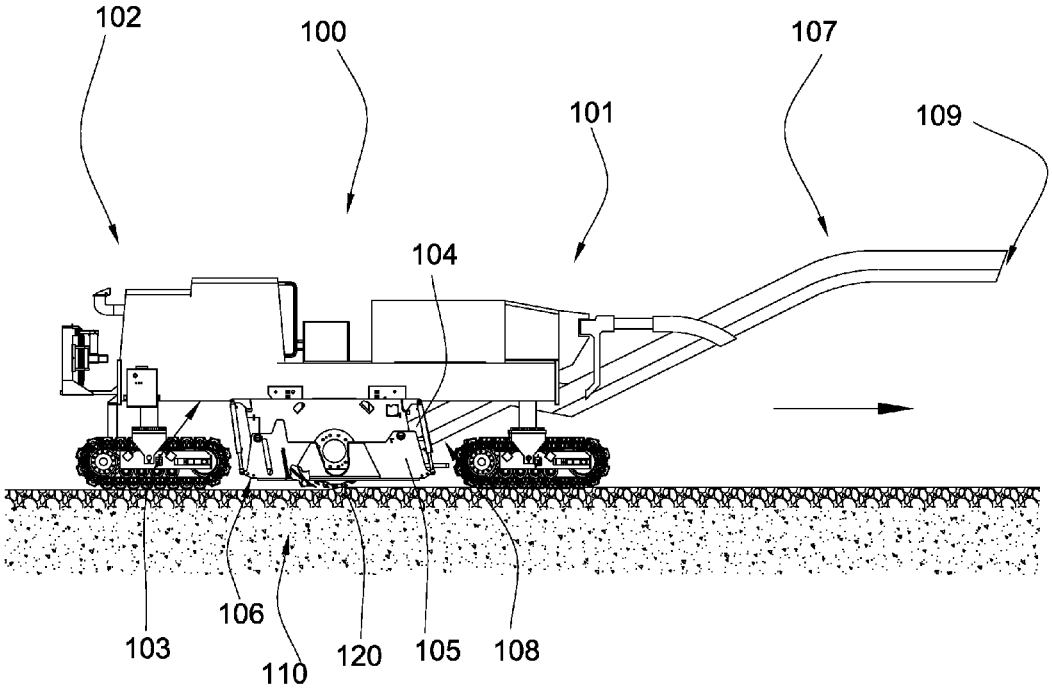
FIG. 1 is an orthogonal view of an embodiment of a vehicle.

FIG. 1 discloses an embodiment of a vehicle 100, such as a milling machine. The vehicle has a forward end 101 and a rearward end 102. An excavation chamber 110 is attached to the underside 103 of the vehicle's frame. The excavation chamber 110 is formed by a front plate 104, side plates 105, and a moldboard 106. The excavation chamber 110 encloses an excavation drum 120, which is supported by the side plates. A conveyor 107 is also supported by the vehicle. An intake end 108 of the conveyor enters the excavation chamber 110 through an opening formed in the excavation chamber 110, usually formed in the front plate 104, but the opening may be formed in any portion of the excavation chamber 110. The excavation drum 120 is configured to drop aggregate onto the conveyor proximate its intake end. The conveyor transports the aggregate from the intake end to the output end 109.

Figure 2:
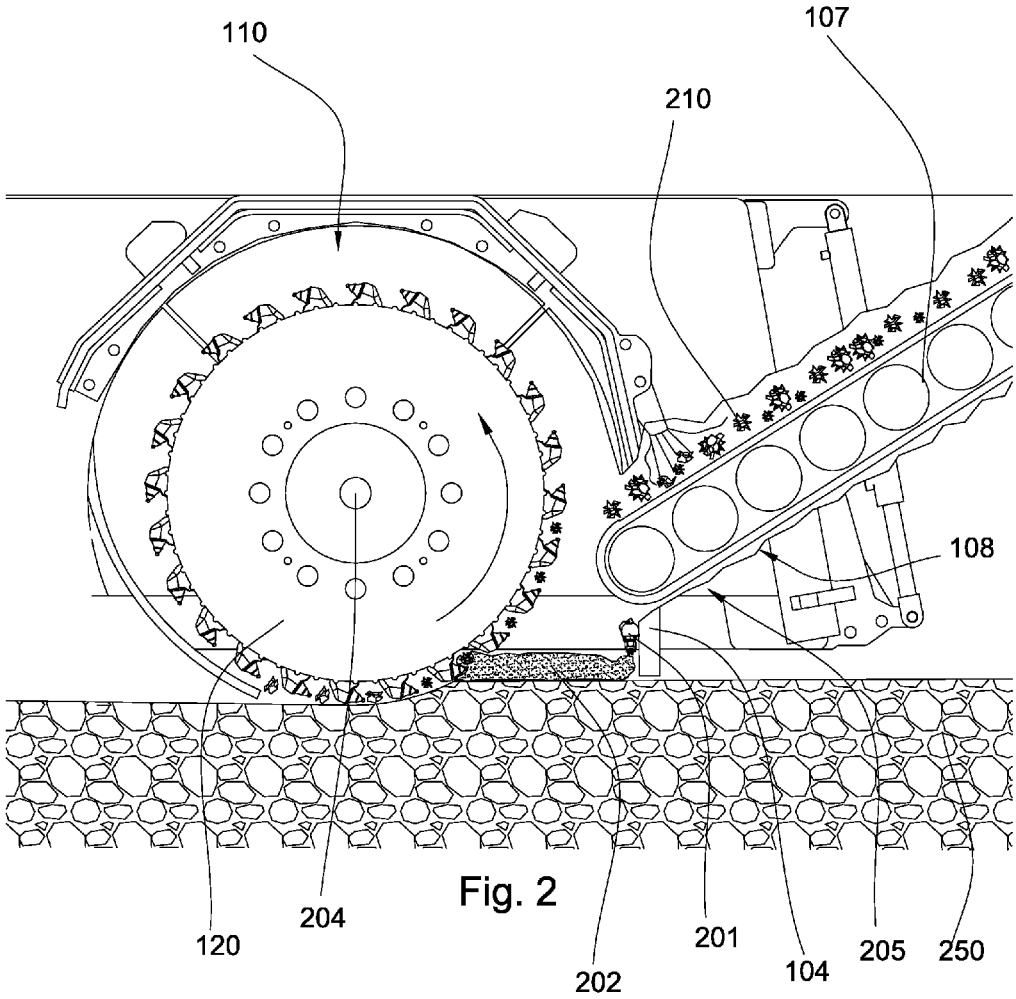
FIG. 2 is a cross sectional view of an embodiment of an excavation chamber.

FIG. 2 discloses a dust suppressant nozzle 201 proximate the front plate 104 of the excavation chamber 110. The dust suppressant nozzle 201 may apply a foamed dust suppressant 202 to a natural or man-made surface 250, such as a concrete or asphalt surface, prior to being degraded by the excavation drum 120. The axle 204 of the excavation drum 120 is supported by the side plates 105 as shown is FIG. 1. The surface may include the portion of the surface that has yet to be engaged by the excavation drum as well as the cut portion of the surface.

In the preferred embodiment, the excavation drum 120 lifts the aggregate 210 within the excavation chamber 110 and allows the aggregate 210 to fall onto the intake end 108 of the conveyor 107 that protrudes through an opening 205 in the front plate 104 into the excavation chamber 110.

Figure 3:
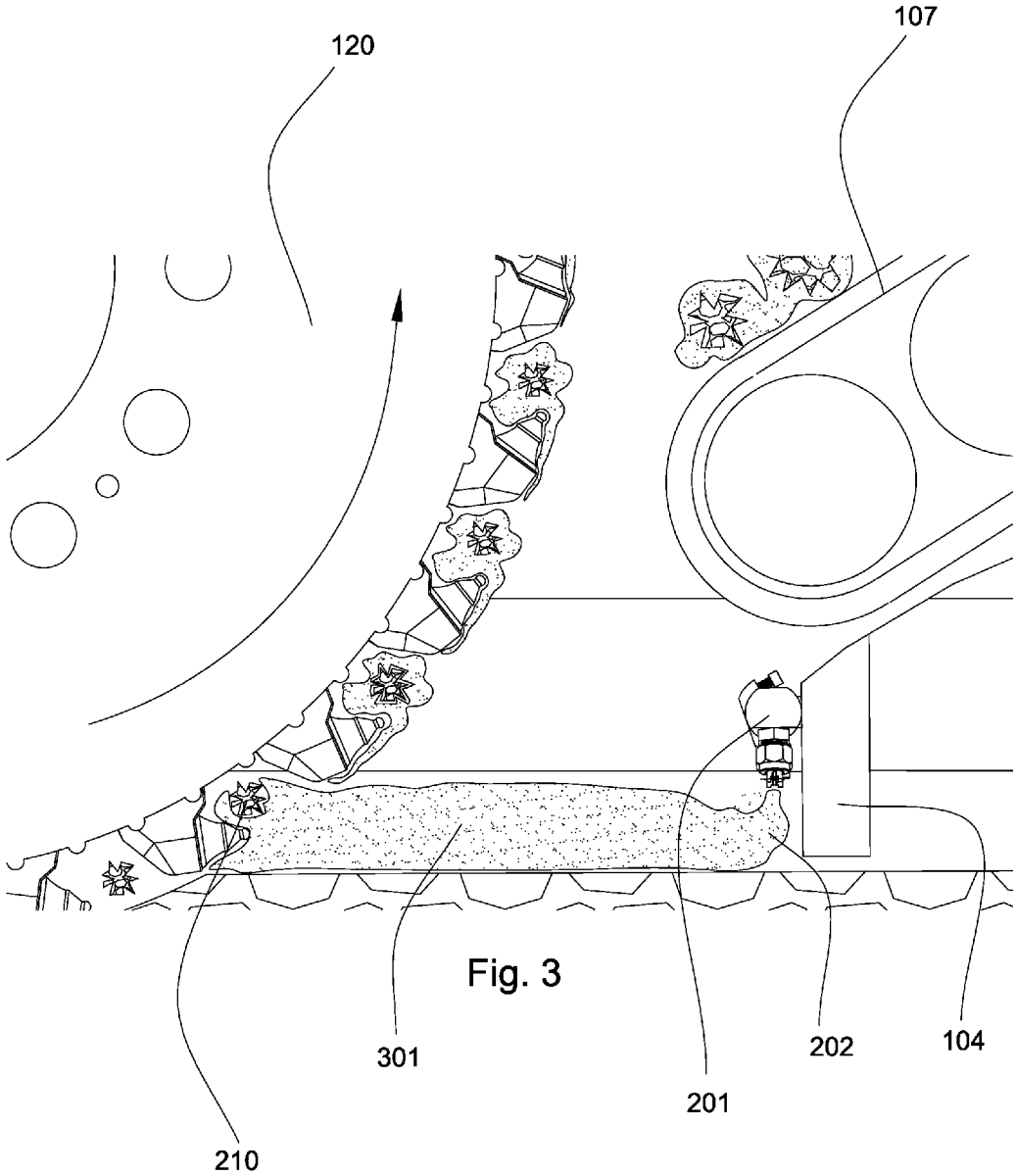
FIG. 3 is a cross sectional view of an embodiment of a dust suppressant nozzle.

FIG. 3 discloses the dust suppressant nozzle 201 attached to the front plate 104. The dust suppressant nozzle 201 may apply a foamed dust suppressant 202 to form a foam blanket 301 over the natural or man-made surface preceding the excavation drum 120. The excavation drum 120 may be configured to move the aggregate 210 through the foamed dust suppressant 202. The foamed dust suppressant may be configured to coat the aggregate as the aggregate moves through the foam. The foam that coats the aggregate and/or surface may form an impermeable layer to dust that prevents the dust particles associated with the aggregate to go airborne. Existing dust may be further minimized by the dust particles absorbing moisture from the foam, thereby, adding too much weight to the dust to be airborne.

In some embodiments, the foamed dust suppressant 202 has a half life long enough to last the duration between applying the foamed dust suppressant 202 to a natural or man-made surface and discharging the foamed dust suppressant with the aggregate 210 off the output end 109 of the conveyor 107. Preferably the half life is long enough to keep the dust suppressed while the aggregate 210 is transported by the conveyor 107 and while the aggregate 210 is discharged from the output end 109 of the conveyor 107.

Figure 4:
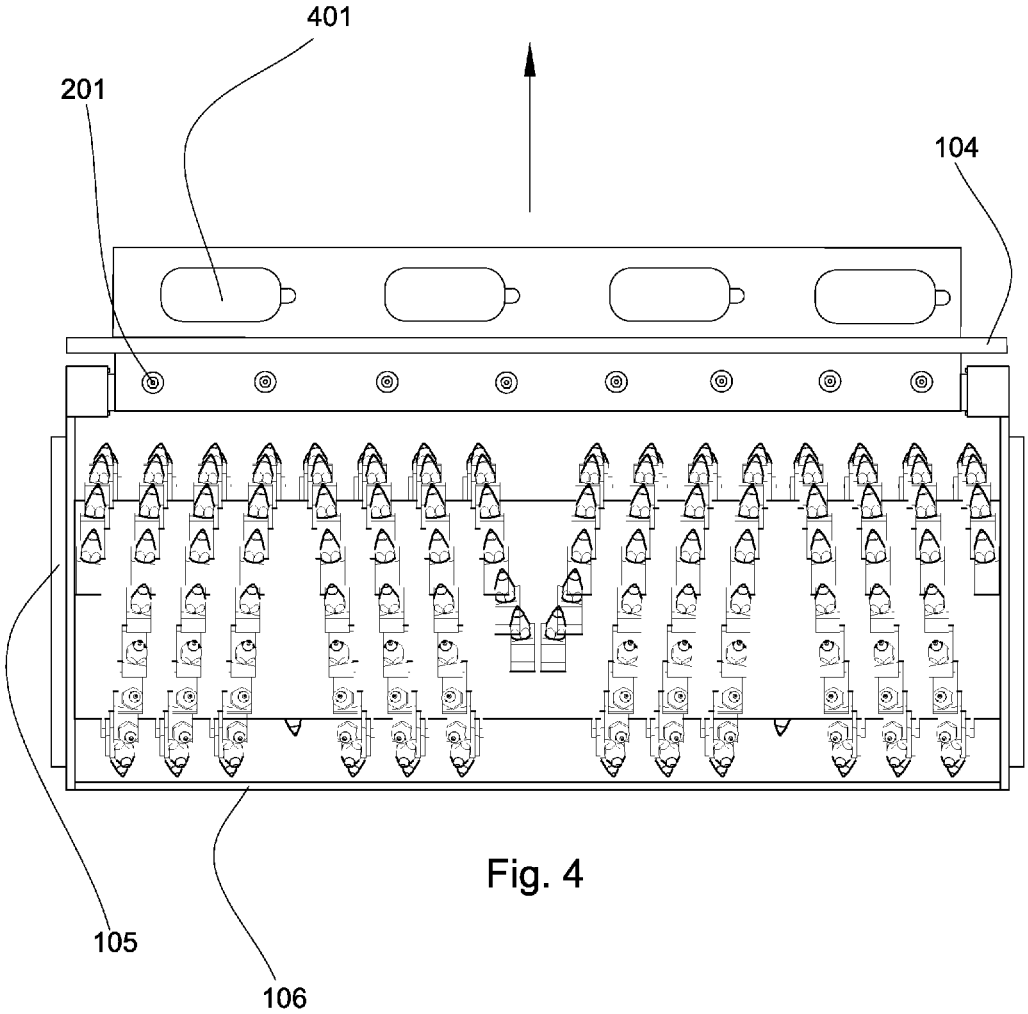
FIG. 4 is an orthogonal view of another embodiment of an excavation chamber.

FIG. 4 discloses an air compressor 401 attached proximate the excavation chamber 110. The air compressor 401 may be used to cause a liquid dust suppressant and air to mix to form the foamed dust suppressant 202. The liquid dust suppressant may comprise water and a foaming agent. In some embodiments, the air compressor may be used to cause the liquid dust suppressant and air to mix prior to exiting the dust suppressant nozzle. The air compressor may be attached outside of the excavation chamber or, in some embodiments, inside the excavation chamber.

Figure 5:
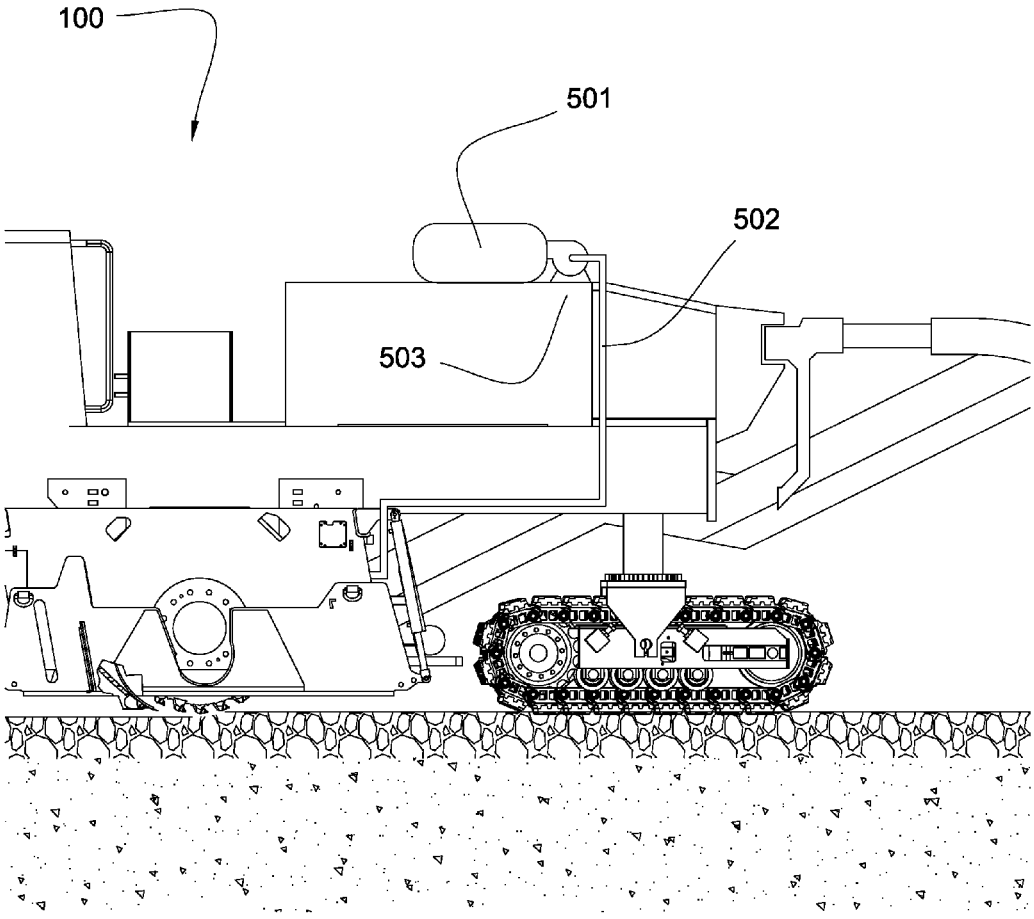
FIG. 5 is an orthogonal view of an embodiment of a mechanism for applying the foamed dust suppressant.

FIG. 5 discloses a mechanism for applying the foamed dust suppressant that comprises the dust suppressant nozzle, at least one fluid line, a fluid tank, an air compressor, and a pump. The fluid tank 501 may be secured to the vehicle 100. The fluid tank may be in fluid communication with the air compressor 401 and a dust suppressant nozzle 201 through at least one fluid line 502. The mechanism for applying the foamed dust suppressant may have a pump 503 configured to pressurize the water that is mixed with the foaming agent to form the foamed dust suppressant 202.

Figure 6A:
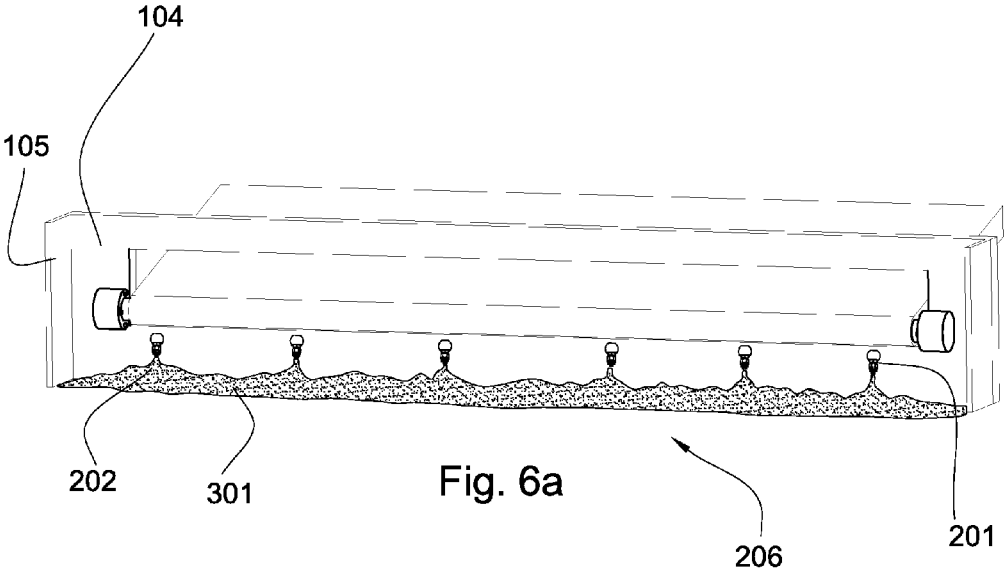
FIG. 6*a* is a perspective view of another embodiment of a dust suppressant nozzle.

FIG. 6*a* discloses a plurality of dust suppressant nozzles supported by the front plate 104. In another embodiment a dust suppressant nozzle 201 may be supported by the side plates and/or conveyor. The dust suppressant nozzle may be configured to form a foam blanket over the natural or man-made surface preceding the excavation drum 120. The foam blanket may be configured to span the foamed dust suppressant across the width of a cut formed by the excavation drum into the natural or man-made surface.

Figure 6B:
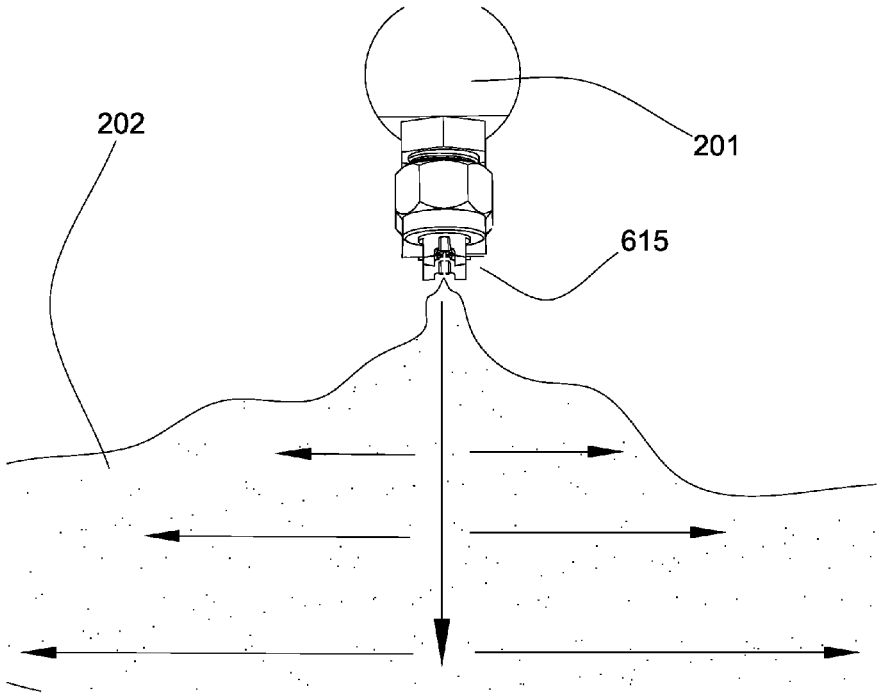
FIG. 6*b* is a detailed view of another embodiment of a dust suppressant nozzle.

FIG. 6*b* discloses a dust suppressant nozzle 201 discharging a foamed dust suppressant 202. The liquid dust suppressant may be mixed with air under pressure prior to ejection from the nozzle. The mixture of air and liquid dust suppressant may depressurize as the liquid dust suppressant and the air move from the pressurized environment prior to ejection from the nozzle, into the atmospheric pressure after ejection. This depressurization may cause the mixture to expand forming a foamed dust suppressant 202. The liquid dust suppressant may have a greater volume when mixed with air to form the foamed dust suppressant, thereby, requiring less liquid dust suppressant to be utilized in the excavation process.

In another embodiment, the dust suppressant nozzle 201 may have a valve 615 that is configured to adjust the characteristics of the foamed dust suppressant. The valve 615 may cause the dust suppressant nozzle 201 to apply a light or heavy foamed dust suppressant 202. The valve 615 may also cause the foamed dust suppressant 202 to have a wetter or dryer consistency. Dryer foam may be configured to be a foam that blocks dust from becoming airborne.

On the other hand, wetter foam may retain moisture for a significant period of time. Thus, the nozzles may deposit the foam on the surface with the anticipated amount of moisture needed to keep dust at a minimum during the cutting. The foam may hold the moisture on the surface until the aggregate is brought through the foam and the moisture from the foam wets the aggregate. Temporarily storing the moisture in foam on the surface is believed to be more efficient than spraying the surface because spray particles tend to have large enough masses to disrupt the air around the dust, thereby, kicking up unwetted dust particles. Further, the dust particles tend to avoid being hit by the spray particles because the dust particles are so light that the air disturbance created by the spray particles' movement actually pushes the dust particles away.

The foam may be configured to expand at a ratio of 1:10 to 1:500. However, the expansion ration may be preferably around 1:100.

The expansion of the foam may determine the number of nozzles needed to adequately cover the surface within the excavation chamber. After ejection from the nozzle, the foam may expand in every direction, including to the side.

Foaming may be configured to provide an efficient distribution of moisture over the surface. Unlike spray particles, which concentrate their moisture in large particles that tend to pool in the lowest portions of the surface, foam's structure may spread the moisture out more evenly across the surface irrespective of the surface's elevation changes. Thus, foaming may obtain similar results as spraying, but with significantly reduced amounts of moisture applied.

Further, another advantage that the foam provides is holding the moisture where the foam was deposited until the degraded by the excavation drum. In spray applications, water will flow along the path of least resistance, and usually pool in the lowest spot on any surface. This is problematic because water runoff from dirty roads is considered to be a significant environmental hazard. However, the structure of foam will resist its moisture from the pooling and thereby prevent runoff and reduce the amount of moisture needed to reduce dust.

Further, the foam may be used to apply chemicals or agents to the surface that may affect how the surface is degraded. For example, surfactants, waxes, binders, oils, water, clays, salts, mixtures, and combinations thereof may be added to the foam.

The foam may also absorb heat generated through the degradation process, which may reduce thermal damage to the drum, aggregate, and picks. In fact, the foam may help reduce friction between the picks and the surface. In some embodiments, the foam may also reduce sparks between the picks and surface. By reducing the friction, the pick tips may stay sharper longer.

In some embodiments, the size and shape of the aggregate may be valuable. For example, road aggregate may be recycled, but often road milling machines produce too many fines to make a new road of entirely recycled aggregate. Thus, recycled aggregate usually only supplements fresh aggregate. Further, in mining applications, the aggregate may be reduced further after extraction from the mine. However, this aggregate may be sorted by size and distributed to the appropriate crusher or impactor that is most efficient for reducing the particular sizes. Often, prior art excavation processes allow dust, fines, and aggregate to collide. Due to these collisions, the picks' tips wear faster and more fines are generated. However, foam may reduce these collisions may help control the size and shape of the aggregate produced. Additionally, picks that wear slower are more capable of producing consistent aggregate sizes and shapes.

In some embodiments, the valves 615 of the dust suppressant nozzles may be adjusted individually across the span of the excavation chamber 110. The dust suppressant nozzles proximate an area of greater aggregate density may be configured apply a greater amount of foamed dust suppressant or wetter foam. For example, the drum may be configured to direct the aggregate to the center of the excavation chamber where the drum is configured to direct the aggregate towards the conveyor. In other embodiments, the drum may be configured to move the aggregate to one side of the excavation chamber. In some embodiments, the dust suppressant nozzles may be tailored to provide a thick dry layer of foam near the side plates configured to create a barrier that prevents dust from leaving the excavation chamber 110. Thus, the foam may be tailored to perform different functions along the width of the excavation chamber. Some of the foam parameters that may be adjusted across the width may include: moisture content, thickness, expansion ratio, density, and half life.

Figure 7:
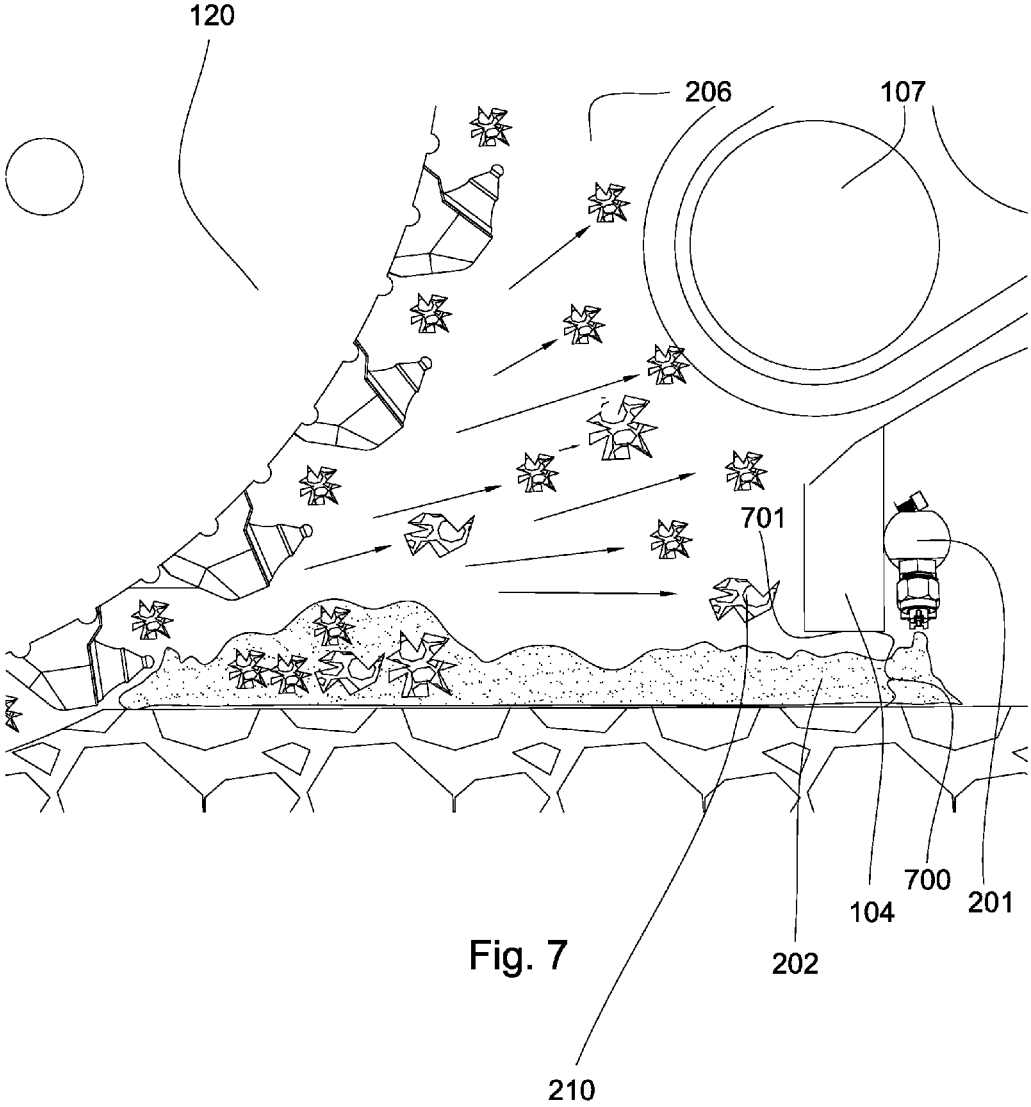
FIG. 7 is an cross sectional view of another embodiment of a dust suppressant nozzle.

FIG. 7 discloses another embodiment of a dust suppressant nozzle 201 attached to the front plate 104 outside of the excavation chamber 110. Placing the nozzles outside of the excavation chamber may avoid damaged caused by the excavation drum 120 throwing the aggregate 210 forward and hitting the nozzles. The front plate 104 may shield the dust suppressant nozzle 201 from the aggregate 210. A gap 700 may exist between the surface and the bottom 701 of the front plate that is configured to allow foam to let foam enter the excavation chamber. The thickness of the foam allowed to enter the excavation chamber may be controlled by the height of the gap.

Figure 8:
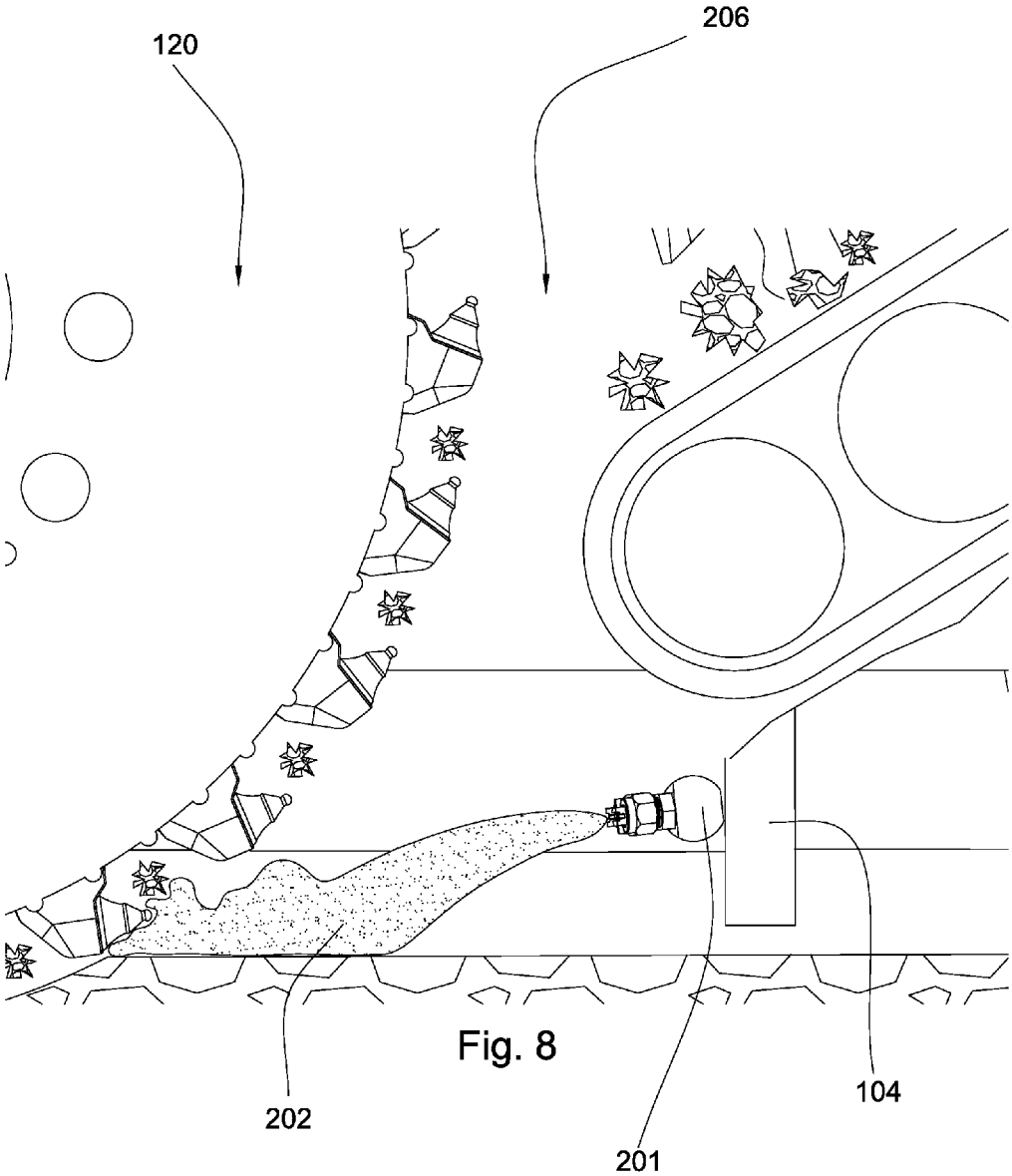
FIG. 8 is an cross sectional view of another embodiment of a dust suppressant nozzle.

FIG. 8 discloses another embodiment of a dust suppressant nozzle 201 attached to the front plate 104 inside the excavation chamber 110. The dust suppressant nozzle 201 is attached to the front plate 104 at an angle to dispense the foamed dust suppressant 202 in the direction towards the excavation drum 120. The dust suppressant nozzle 201 may be attached to the front plate 104 at an angle that allows the foamed dust suppressant 202 to be applied to the area immediately preceding the excavation drum 120.

Figure 9A:
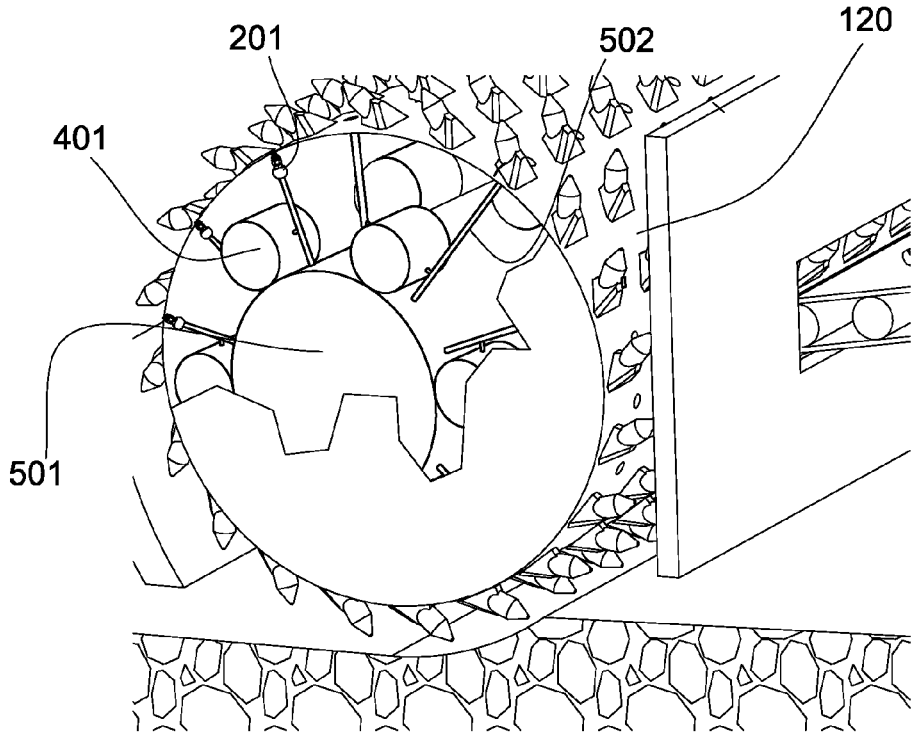
FIG. 9*a* is a perspective view of another embodiment of a dust suppressant nozzle.

FIG. 9*a* discloses an embodiment of a dust suppressant nozzle 201 incorporated into the excavation drum 120. The dust suppressant nozzle 201 may be in fluid communication with a fluid tank 501 and an air compressor 401 through a fluid line 502 inside the excavation drum 120. A plurality of dust suppressant nozzles, fluid tanks, air compressors, and fluid lines may control the distribution of foamed dust suppressant 202.

Figure 9B:
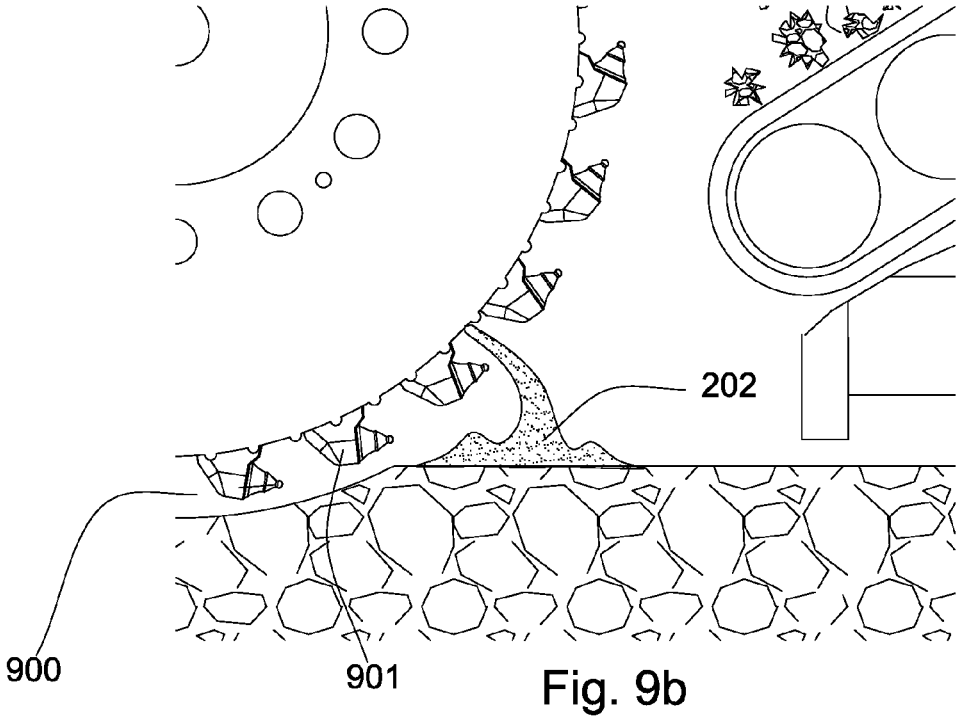
FIG. 9*b* is a cross sectional view of another embodiment of a dust suppressant nozzle.

FIG. 9*b* discloses the dust suppressant nozzle discharging the foamed dust suppressant 202 onto the natural or man-made surface prior to being degraded by the excavation drum 120. The nozzle may deposit the foam on the surface before the drum engages the surface. However, in some embodiments, the nozzles may be configured to deposit the foamed dust suppressant in the cut region 900 of the surface. The nozzle may inject foamed dust suppressant into the cut region while the drum is rotating and a pick 901 following the nozzle may degrade the surface within the cut region after the foam is deposited.

Figure 10:
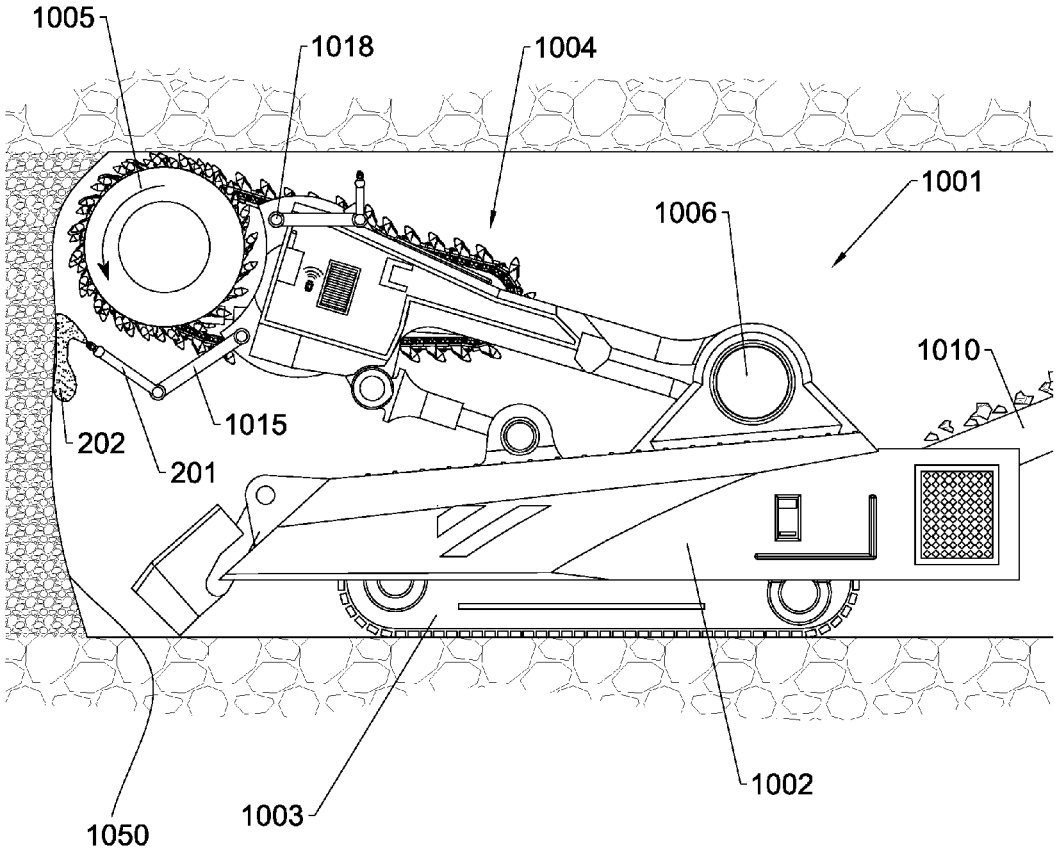
FIG. 10 is an orthogonal view of another embodiment of a machine.

FIG. 10 discloses an embodiment of a machine 1001, such as a continuous miner. The machine 1001 may comprise a main frame 1002 on continuous tracks 1003. A turret 1006 may be attached to the topside 1020 of the main frame 1002. A pair of forwardly directed loading arms 1004 may be attached to the turret 1006. An excavation drum 1005 may be supported by the loading arms 1004. The loading arms 1004 may be configured to lift and lower the excavation drum 1005. A retractable nozzle support 1015 may be attached to the loading arms 1004. The retractable nozzle support 1015 may comprise a nozzle support pivot 1018 configured to rotate the retractable nozzle support 1015 into or out of position depending on the direction that the loading arms are directing the drum. A dust suppressant nozzle 201 may be attached to the retractable nozzle support 1015. The dust suppressant nozzle 201 may be configured to apply a foamed dust suppressant 202 to the natural or man-made surface prior to being degraded by the excavation drum 1005. In some embodiments, the foam is deposited on the wall 1050 below the drum and when the aggregate is loosened from the wall and falls, the aggregate falls through the foam. In this manner, the aggregate may be wetted by the foam.

Figure 11:
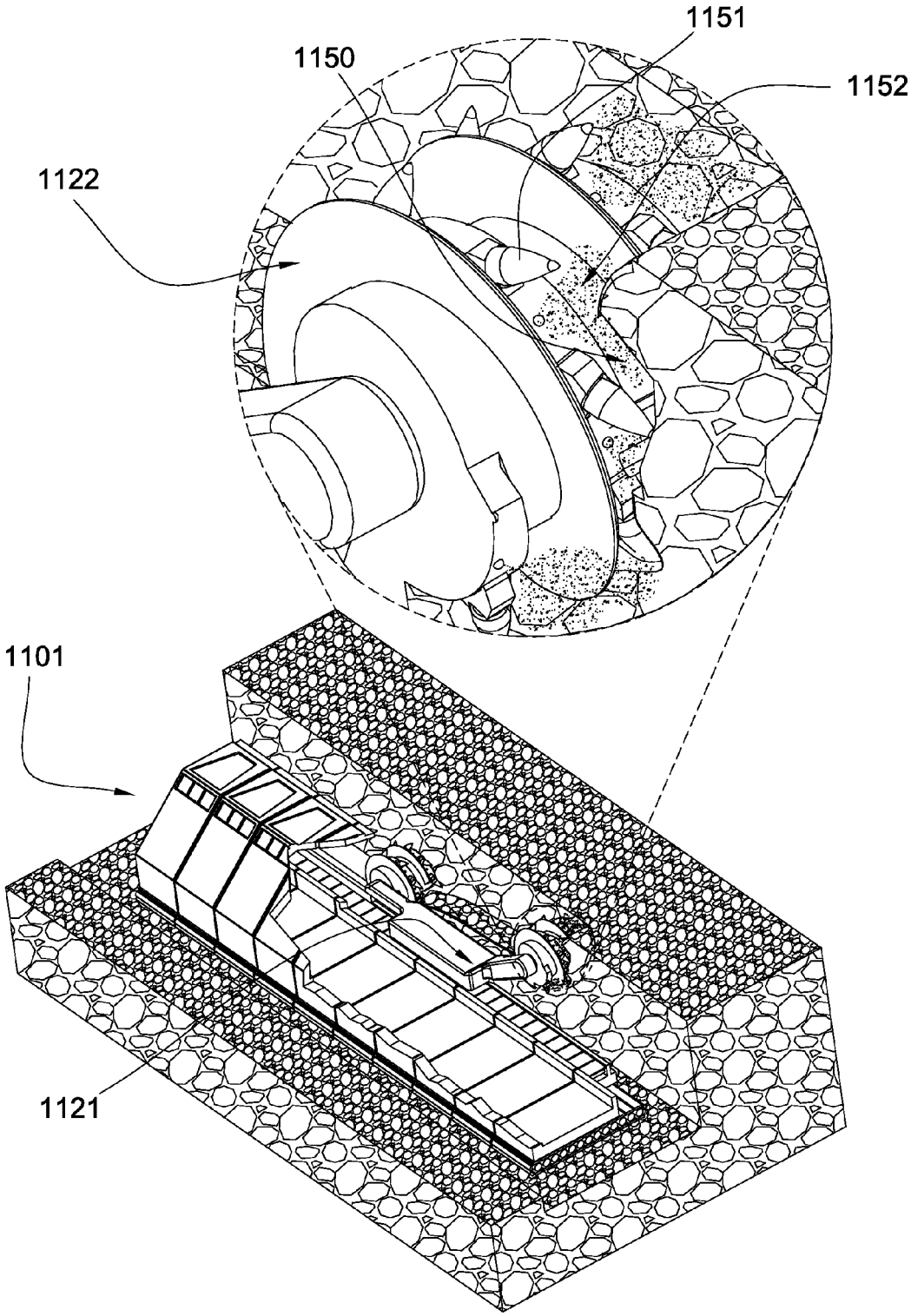
FIG. 11 is a perspective view of another embodiment of a machine.

FIG. 11 discloses another embodiment of a machine 1101, such as a long wall miner. The machine 1101 may comprise a main frame on endless tracks. A conveyor may be attached to the main frame. The conveyor may be configured to transport aggregate away from the excavation site. A moveable arm 1121 may be attached to the main frame. The movable 1121 arm may move along a track that runs substantially parallel to the front side of the machine 1101. An excavation drum 1122 may be supported by the movable arm 1121. In the embodiment shown in FIG. 11, a nozzle 1152 is incorporated directly into the drum and configured to deposit a foamed aggregate onto the surface of the wall surface 1150 prior to the pick 1151 that follows the nozzle degrades the wall surface.

The use of foam in mining applications avoids the use of excessive amounts of water. Foam may expand up to 1:500, which demonstrates that foam may use a fraction of the water to cover the same surface. Also, in underground mining, the prior art technique of spraying water requires more resources because the water immediately runs off the wall to be milled. While foam is still subject to gravity, foam is lighter and may have better adhesion to the walls, thereby requiring less moisture resources per surface area.

Foam may reduce dust, cool picks, and prevents sparks. When mining combustible natural resources spark reduction may save lives. The foam may cool the spark particles immediately after the spark is generated, isolate the spark particle from combustible gases, and/or keep the surface and picks cool enough that spark particles do not form.

Figure 12:
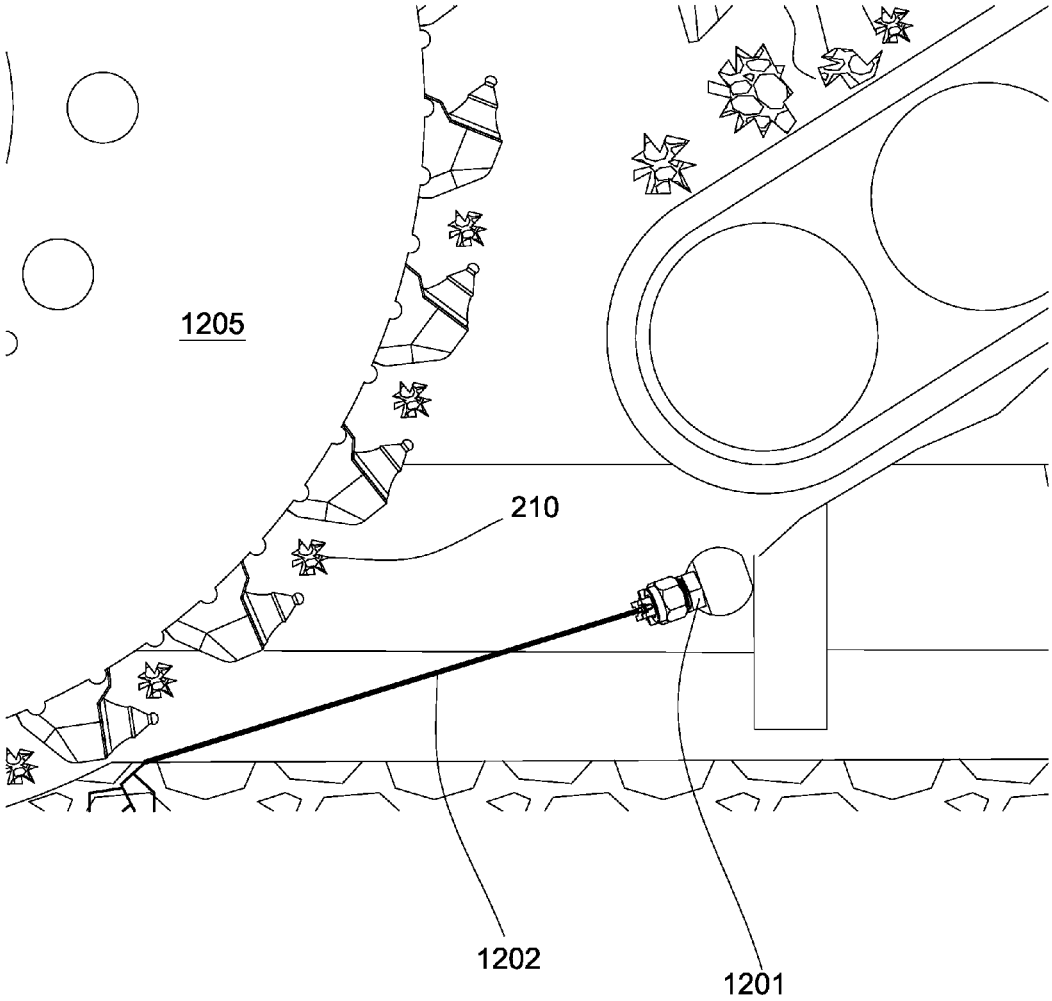
FIG. 12 is an orthogonal view of an embodiment of a spray nozzle.

FIG. 12 discloses an embodiment of a nozzle 1201 configured to apply a liquid 1202 to the natural or man-made surface prior to being degraded by the excavation drum 1205. The liquid 1202 may be a liquid dust suppressant that comprises water and a dust binding agent.

In another embodiment, the nozzle 1201 may be a spray nozzle configured to spray the natural or man-made surface prior to being degraded by the excavation drum 1205. The spray nozzle may be a hydraulic nozzle, an air-assisted nozzle, or an ultrasonic nozzle. The type of nozzle may have a specific spray pattern or spray characteristics that may be more effective for a certain condition to most effectively suppress the dust. The nozzle 1201 may have multiple orifices. The multiple orifices may create multiple streams of liquid 1202 from the same nozzle 1201. The multiple orifices may also allow a single nozzle to spray liquid 1202 to a greater area than a single orifice nozzle.

In another embodiment, the nozzle 1201 may be a fogging nozzle configured to wet the natural or man-made surface prior to being degraded by the excavation drum.

In another embodiment, the nozzle 1201 may be a water jet cutting nozzle configured to jet liquid 1202 in the direction towards the natural or man-made surface proximate the cut formed by the excavation drum 1205 into the natural or man-made surface. The water jet cutting nozzle may be configured to degrade the natural or man-made surface preceding the cut formed by the excavation drum 1205 into the natural or man-made surface. The degradation of the natural or man-made surface by the water jet cutting nozzle reduce the resistance of the natural or man-made surface to the degradation of the excavation drum. The degradation of the natural or man-made surface by the water jet cutting nozzle may also prolong the life of the excavation drum 1205.

The water jet cutting nozzle may also be configured to clean the excavation drum 1205 of aggregate 210. The aggregate 210 may cling to the excavation drum 1205 during the excavation process. The excess aggregate 210 decreases the efficiency of the excavation process. The water jet cutting nozzle may jet liquid 1202 in the direction towards the excavation drum 1205 to expel the excess aggregate 210.

Figure 13:
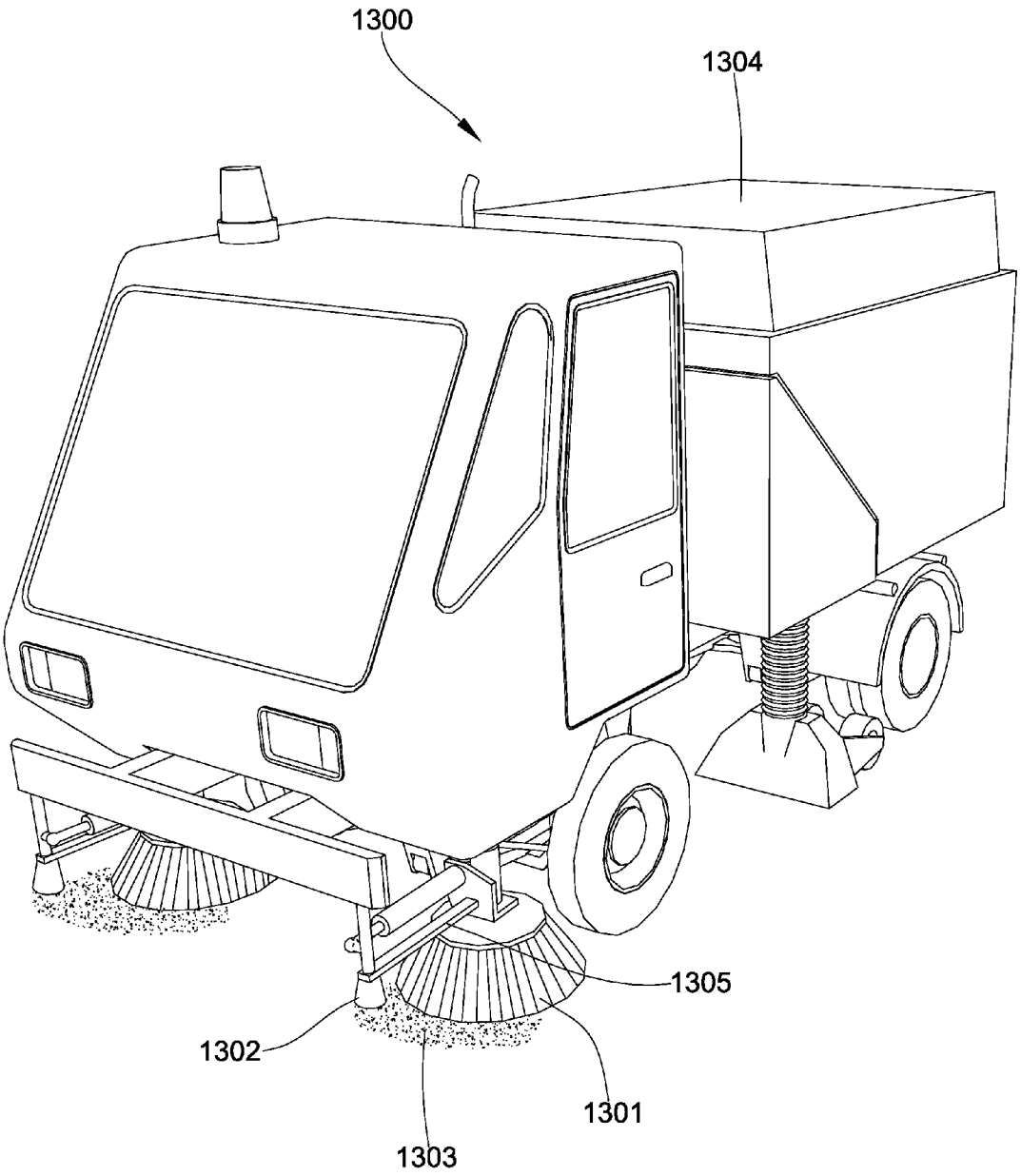
FIG. 13 is a perspective view of another embodiment of a vehicle.

FIG. 13 discloses a vehicle 1300 with a rotary brush 1301 that is configured to direct debris on a paved surface towards a storage compartment 1304 located on the vehicle. The vehicle may be a street sweeper that is configured to clean the paved surface. In this embodiment, the rotary brush is configured to rotate about an axis that is substantially normal to the paved surface. Paved surfaces may include roads, highways, construction sites, bridges, runways, parking lots, sidewalks, floors, and community squares. The vehicle also comprises a dust suppressant nozzle 1302 that is configured to apply a foamed dust suppressant 1303 to the paved surface prior to being cleaned by the rotary brush.

The foamed dust suppressant may reduce dust by foaming a foam blanket over the paved surface and the debris that the vehicle intends to clean. Once deposited, the foamed blanket may expand, and thereby cover more surface area, until removed by the rotary brush. The foam may be light enough that the foam coats the debris without substantially displacing the air around the debris, and thereby, avoids kicking up additional dust. Stirring up additional dust may be hazardous in dusty applications. For example, street sweepers are often used to clean up after a milling machine has milled a road surface, and the resulting degraded road surfaces may comprise a substantial amount of fine aggregate that may be potential air borne dust. By coating over this fine aggregate with a foam blanket, the foam may become a protective layer that insulates the dust from the forces that would cause the dust to become airborne. Also, the foam may transfer moisture to the fine aggregate and thereby cause the dust to be too heavy to become airborne.

Further, another advantage that the foam provides is holding the moisture where the foam was deposited until the rotary brush directs it to the storage compartment. In spray applications, water will flow along the path of least resistance, and usually pool in the lowest spot on any surface. This is problematic because water runoff from dirty roads is considered to be a significant environmental hazard. However, the structure of foam will resist its moisture from the pooling and thereby prevent runoff and reduce the amount of moisture needed to clean a road surface.

In the embodiment of FIG. 13, the rotary brush is configured to move independent of the vehicle's frame. A control system to move the brush may comprise a linkage 1305 that may adjust the position the brush. The linkage may be mechanically, electrically, and/or hydraulically controlled. In this manner, the brush may clean hard to reach areas that may be precluded from being cleaned due to the size of the vehicle. For example, the independently movable brush may extend into corners and gutters, reach under benches, clean around walls stands, and follow edges. In some embodiments, the brush may be configure to clean at a different angle to clean uneven or uniform surfaces. The nozzle may be configured to move with the brush.

The dust suppressant nozzle may disposed at an angle to dispense the foamed dust suppressant in the direction away from the rotary brush. Also, the vehicle may comprise a mechanism for applying the foamed dust suppressant that comprises the dust suppressant nozzle, at least one fluid line, a fluid tank, an air compressor, and a pump at least similar to that described above in connection with the excavation drum. The air compressor may mix air with a liquid dust suppressant to form the foamed dust suppressant. In some embodiments, a pump may be needed to pressurize the water that is mixed with the foaming agent to form the foamed dust suppressant. The liquid dust suppressant may comprise water and a foaming agent. Preferably, the air and a liquid dust suppressant are mix before the foamed dust suppressant exits the dust suppressant nozzle. In some embodiments, the dust suppressant nozzle may comprise a valve that is configured to adjust the consistency of the foamed dust suppressant.

Figure 14:
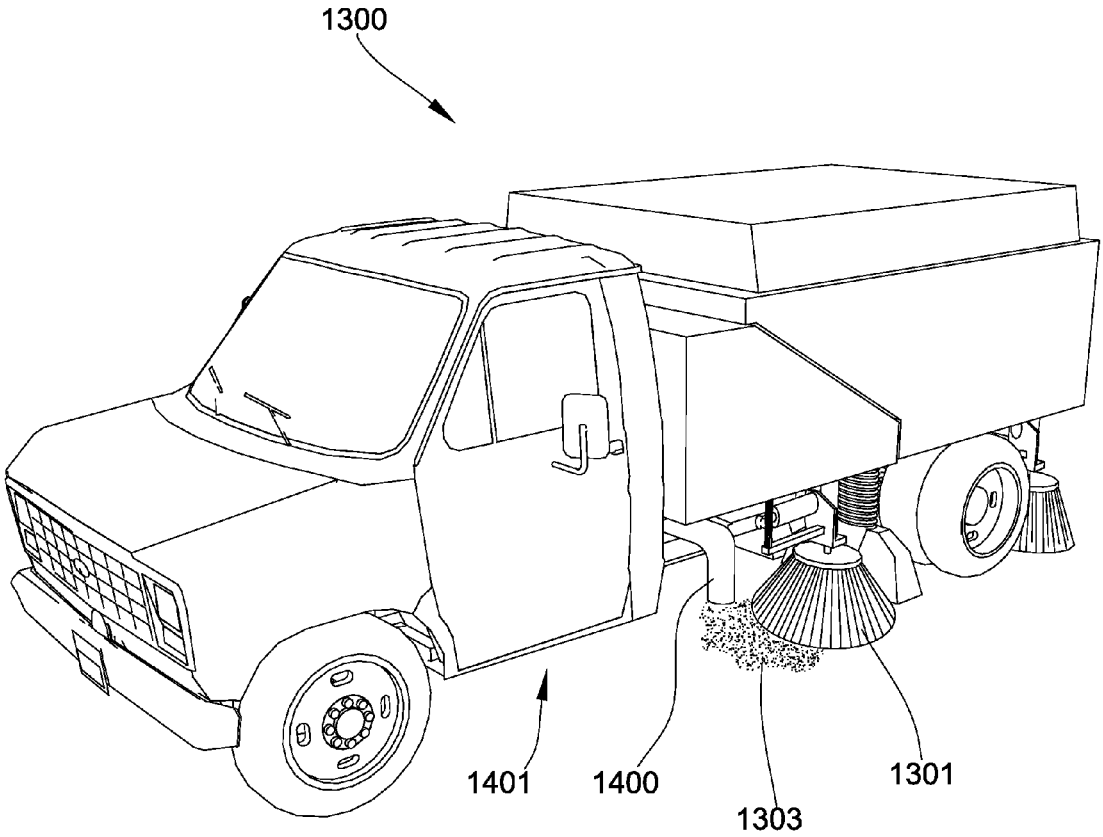
FIG. 14 is a perspective view of another embodiment of a vehicle.

FIG. 14 discloses a rotary brush 1301 that is attached to the underside 1401 of the vehicle 1300 and configured to dispense foam 1303 onto a paved surface. In this embodiment, the nozzle is rigidly attached to the frame of the vehicle.

Figure 15:
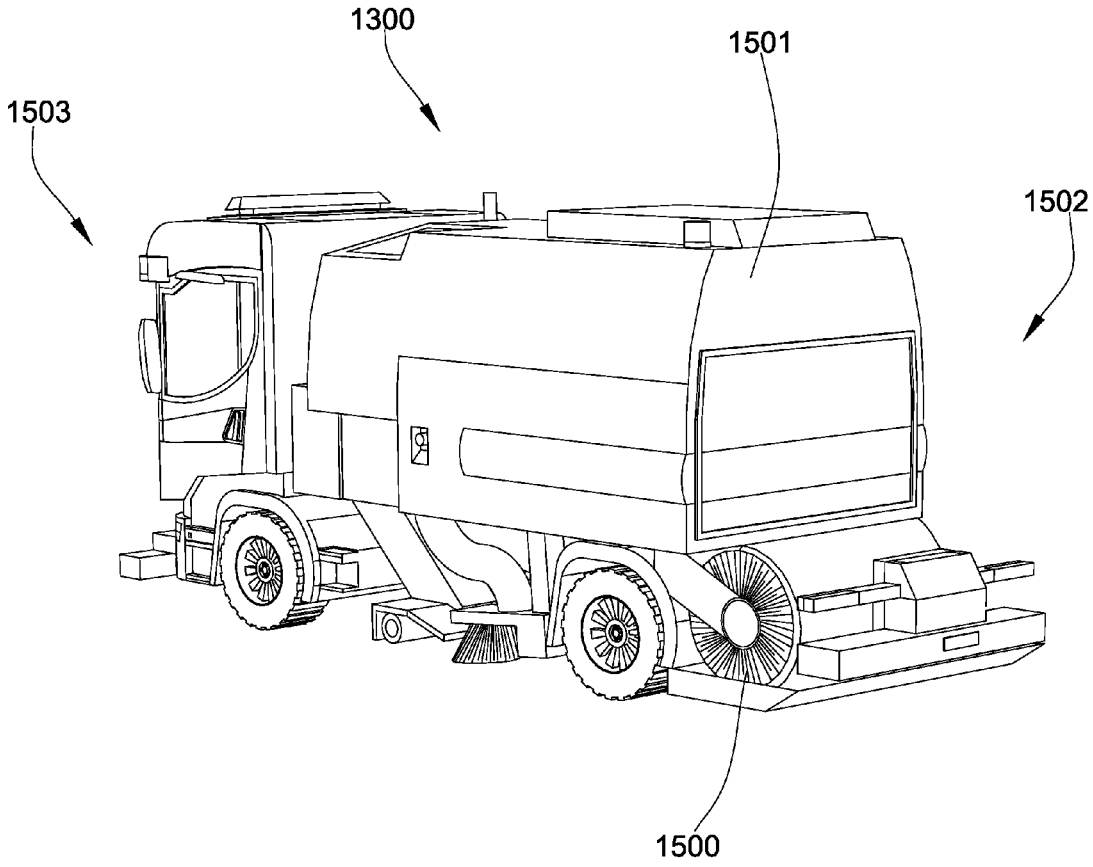
FIG. 15 is a perspective view of another embodiment of a vehicle.

FIG. 15 discloses a vehicle 1300 with a rotary brush 1500 that is configured to rotate about an axis that is substantially parallel with the paved surface. The brush is configure to direct the debris into a storage compartment 1501 located on the vehicle. While the present embodiment discloses the brush attached to the vehicle's underside and attached to a rear end 1502 of the vehicle, rotary brushes that rotate about axes substantially parallel to the road surface may be attached to the vehicle in other places. For example, the brush may be attached to the forward end 1503 of the vehicle and pushed by the forward end.

Whereas the present invention has been described in particular relation to the drawings attached hereto, it should be understood that other and further modifications apart from those shown or suggested herein, may be made within the scope and spirit of the present invention.

What is claimed is:

1. A system for removing aggregate from a surface, comprising:

an excavation drum connected to a vehicle;

a dust suppressant nozzle attached to the vehicle forward of the excavation drum; and a foam blanket disposed on the surface by the dust suppressant nozzle forward of the excavation drum.

2. The system of claim 1, wherein the dust suppressant nozzle applies the foam blanket to the surface within an excavation chamber that surrounds the excavation drum.

3. The system of claim 2, further comprising a conveyor with an intake end within the excavation chamber and an output end; wherein the foam blanket comprises a half life that is at least as long as the duration between applying the foam blanket surface and discharging the foam blanket with broken aggregate off the output end of the conveyor.

4. The system of claim 1, wherein the foam blanket spans across a width of a cut formed by the excavation drum into the surface.

5. The system of claim 1, wherein the foam blanket expands until it is degraded by the excavation drum.

6. The system of claim 1, wherein the excavation drum moves aggregate through the foam blanket.

7. The system of claim 6, wherein the foam blanket coats the aggregate as the excavation drum moves the aggregate through the foam blanket.

8. The system of claim 1, further comprising an excavation chamber surrounding the excavation drum; a conveyor with an intake end within the excavation chamber and an output end; wherein the excavation drum lifts the aggregate within the excavation chamber and allows the aggregate to fall onto the intake end of the conveyor that protrudes into the excavation chamber.

9. The system of claim 1, further comprising an excavation chamber surrounding the excavation drum; wherein the dust suppressant nozzle is disposed on the inside of the excavation chamber.

10. The system of claim 1, wherein the vehicle comprises a mechanism for applying the foam blanket comprising the dust suppressant nozzle, at least one fluid line, a fluid tank, an air compressor, and a pump.

11. The system of claim 1, wherein an air compressor mixes air with a liquid dust suppressant to form the foam blanket.

12. The system of claim 11, wherein the liquid dust suppressant comprises water and a foaming agent.

13. The system of claim 12, wherein a pump pressurizes the water that is mixed with the foaming agent to form the foamed dust suppressant.

14. The system of claim 1, wherein the dust suppressant nozzle comprises a valve to adjust a consistency of the foam blanket.

15. The system of claim 1, wherein the foam blanket is substantially evenly distributed across the surface.

* * * * *